US005511740A

United States Patent [19]

Loubert et al.

[11] Patent Number: 5,511,740

[45] Date of Patent: Apr. 30, 1996

[54] RESISTANCE MECHANISM FOR EXERCISE EQUIPMENT

[75] Inventors: Craig A. Loubert, Minneapolis; Stephen S. Peterson, Maple Grove; Stephen A. Rose, Minneapolis, all of Minn.

[73] Assignee: NordicTrack, Inc., Chaska, Minn.

[21] Appl. No.: 220,800

[22] Filed: Mar. 31, 1994

[51] Int. Cl.[6] ..... A63B 21/015

[52] U.S. Cl. ..... 242/381; 242/381.5; 482/118

[58] Field of Search ..... 242/381, 381.5; 482/115, 116, 118, 119

[56] References Cited

U.S. PATENT DOCUMENTS

| | | | |
|---|---|---|---|
| 2,761,650 | 9/1956 | Faugier | 242/381.5 |
| 2,896,912 | 7/1959 | Faugier et al. | 242/381.6 |
| 3,995,853 | 12/1976 | Deluty | 482/116 |
| 4,511,123 | 4/1985 | Ostrobrod | 242/381.3 |
| 4,846,313 | 7/1989 | Sharp | 242/381.3 |
| 5,090,694 | 2/1992 | Pauls et al. . | |
| 5,147,264 | 9/1992 | Braathen | 482/118 |
| 5,147,265 | 9/1992 | Pauls et al. | 482/119 |
| 5,195,937 | 3/1993 | Engel et al. | 482/119 |
| 5,302,161 | 8/1994 | Loubert et al. | 482/8 |

*Primary Examiner*—John P. Darling

*Attorney, Agent, or Firm*—Merchant, Gould, Smith, Edell, Welter & Schmidt

[57] ABSTRACT

An exercise resistance mechanism provides resistance to unwinding of a flexible line from about a reel. In a preferred embodiment, an arbor is mounted on a shaft by a one-way clutch in such a manner that the arbor rotates in one direction together with the shaft, and rotates in a second, opposite direction relative to the shaft. A first portion of the arbor is connected to an end of a spring extending from a recoil spring pack. A second portion of the arbor is connected to the reel in such a manner that the reel rotates together with the arbor. The arbor and spring end are in full view during assembly of the resistance mechanism. Two holes are provided near the hub of the reel so that a replacement line can be secured to the reel while the original flexible line remains connected thereto and provides a handle for maintaining tension in the recoil spring.

20 Claims, 11 Drawing Sheets

RESISTANCE MECHANISM FOR EXERCISE EQUIPMENT

FIELD OF THE INVENTION

The present invention relates to exercise apparatus and more particularly, to an improved resistance mechanism for exercise equipment.

BACKGROUND OF THE INVENTION

U.S. Pat. No. 5,147,265 to Pauls et al. discloses two embodiments of an exercise resistance mechanism having many positive attributes. One of these embodiments is shown herein at 30 in FIGS. 1–2, and the other of these embodiments is shown herein at 150 in FIGS. 3–5. For ease of reference, all of the reference numerals in FIGS. 1–5 correspond with those in U.S. Pat. No. 5,147,265. These Prior Art embodiments include a pair of recoil spring packs, one of which is shown in greater detail in FIGS. 6–7, and a pair of reels, one of which is shown in greater detail in FIGS. 8–10.

The basic construction and operation of these Prior Art resistance mechanisms will be described with reference to the embodiment 150 shown in FIGS. 3–5. As shown in FIG. 3, a first flexible line 154 extends from the resistance mechanism housing 151 to a remote end connected to a first operable exercise member (not shown), and a second flexible line 155 extends from the resistance mechanism housing 151 to a remote end connected to a second operable exercise member 196. An opposite end of each flexible line 154, 155 is connected to a respective reel 174, 180 within the resistance mechanism housing 151.

Reel 180, which is representative of reel 174, is shown in greater detail in FIGS. 8–10. Each reel includes a one-way clutch assembly 181 mounted within a reel hub 182. The one-way clutch assembly 181 mounts the reel to a shaft 160 in such a manner that the reel rotates in a first direction together with the shaft (indicated by arrows in FIGS. 4 and 10), and the reel rotates in a second, opposite direction relative to the shaft. The only meaningful distinction between the reel 180 and the reel 174 involves the orientation of the one-way clutch assemblies relative to the shaft. In particular, the clutch assemblies must be oriented to lock in the same direction of rotation and free-wheel in the same direction of rotation when the reels 174 and 180 are mounted on the shaft 160 to face away from one another.

A pair of sidewalls 183*a* and 183*b* extend radially away from the hub 182 to define a groove 184 therebetween for receiving several substantially concentric windings of flexible line. A hole 185 is formed through a flanged portion of the hub 182 intermediate the sidewalls 183*a* and 183*b* for purposes of retaining an end of the flexible line 155. During assembly of the resistance mechanism 150, the remote end of the line 155 is threaded through the hole 185, and substantially the entire length of the line 155 is pulled through the hole 185. As shown in FIG. 11, an anchor 199 is secured to the opposite end of the line 155 to prevent the opposite end of the line from pulling through the hole 185. Alternatively, the opposite end of the line can be threaded through the hole 185, and the anchor member secured to the opposite end, or a knot formed in the opposite end, as shown in FIG. 1. The slack in the line is then wound onto the reel 180.

As shown in FIGS. 8–9, the hub 182 extends axially beyond one of the sidewalls 183*a*, and a pair of circumferentially oriented notches 187*a* and 187*b* are formed on the axially extending portion of the hub. One of the notches on each reel engages a spring end 164C extending from a respective recoil spring pack 163, one of which is shown in greater detail in FIGS. 6–7. The recoil spring pack 163 includes a cylindrical shell housing 164A having a central aperture 164B. A torsion spring 164 is concentrically wound within the housing 164A, and a hooked end 164C of the spring 164 extends into the central aperture 164B. The recoil spring pack is secured relative to the resistance mechanism housing 151 by means of screws that pass through holes in outwardly extending flanges on the recoil spring pack and through corresponding holes in inwardly extending flanges on resistance mechanism housing 151.

The reel 180 is positioned adjacent the recoil spring pack 163 in such a manner that the axially extending portion of the hub 182 projects into the central aperture 164B. The hooked end 164*c* of the spring 164 engages the notch 187*b* to connect the recoil spring pack 163 to the reel 180 in such a manner that rotation of the reel in a first direction relative to the recoil spring pack stores energy in the spring (see arrow in FIG. 10), and rotation of the reel in a second, opposite direction relative to the recoil spring pack releases energy from the spring. The only meaningful distinction between the upper and lower spring recoil packs involves the windings of the spring relative to the shaft. In particular, the springs must wind in the same direction of rotation and unwind in the same direction of rotation when the spring recoil packs are mounted on the shaft 160 to face away from one another. As shown in FIG. 6, the upper spring is wound in the opposite direction as the lower spring, and thus, the hooked end of the upper spring engages the notch 187*a* on the upper reel.

As shown in FIGS. 4–5, a rotor 166 is connected to the shaft 160 in such a manner that the rotor rotates together with the shaft. Two diametrically opposed brake shoes 167 and 168 are pivotally mounted to opposite ends of the rotor 166 in such a manner that rotation of the shaft 160 causes the brake shoes 167 and 168 to pivot outward, thereby forcing brake pads 170 against a cylindrical contact surface 153 within the resistance mechanism housing 151.

One problem with the Prior Art resistance mechanisms 30 and 150 involves an assembly step in which the reel is connected to a corresponding recoil spring pack. After the recoil spring pack 163 has been secured within the compartment or pocket 161 of the resistance mechanism housing 151, the end 164C of the spring 164 must be connected to the notch 187*b*. Since the reel 180 obstructs the assembly person's view of the spring end 164C, the connection to the reel must be made by feel without the aid of sight, thereby introducing elements of difficulty and danger into the assembly process. Thus, a need exists to simplify or eliminate this step in the assembly process of this type of exercise resistance mechanism.

Another problem with the Prior Art resistance mechanisms 30 and 150 involves replacement of the flexible line connected to one or both of the reels. The existing line must be removed from the hole 185 in the reel 180 before a new line can be threaded through the hole. However, when the existing line is unwound from the reel to gain access to the end of the existing line, the rewind spring is wound up for purposes of rewinding the reel. At this stage, the reel rotates out of control if the existing line is simply cut, and when the reel stops rotating, no energy is left in the recoil spring for purposes of winding the new line onto the reel. Thus, a need exists to simplify replacement of a flexible line on this type of exercise resistance mechanism.

SUMMARY OF THE INVENTION

The present invention provides an improved exercise resistance mechanism that is easier and safer to manufacture and repair than the Prior Art resistance mechanisms 30 and 150. The present invention also provides an improved exercise resistance mechanism that is less expensive to manufacture and yet functionally superior to the Prior Art resistance mechanisms 30 and 150.

In a preferred embodiment of the present invention, the recoil spring pack is secured within resistance mechanism housing by snap fitting tabs, which mate with recesses in the housing walls, as opposed to flanges extending inward from the housing walls. As a result, a larger diameter recoil spring pack and hence, a more effective recoil spring, can be used within the same size compartment. The preferred embodiment also includes arbors that interconnect the reels and the recoil springs in a manner that eliminates the difficulty and potentially dangerous assembly step required with the Prior Art resistance mechanisms 30 and 150. The one-way clutch assemblies are disposed within the arbors rather than the reels. After the recoil spring pack has been installed, and in full view of an assembly person, the arbor is inserted into the central aperture of the spring pack, and the hooked end of each spring is connected to a notch in a corresponding arbor. Then, the reel is simply mounted on the arbor. The preferred embodiment further includes a pair of holes formed near the hub of each reel to allow a replacement line to be secured to a reel while the original line serves as a handle for preventing undesired rotation of the reel. These and other advantages of the present invention will become apparent upon a more detailed description of the preferred embodiment.

BRIEF DESCRIPTION OF THE DRAWING

In the Drawing, wherein like numerals represent like parts and assemblies throughout the several views.

DETAILED DESCRIPTION OF A PREFERRED EMBODIMENT

Figure 17:
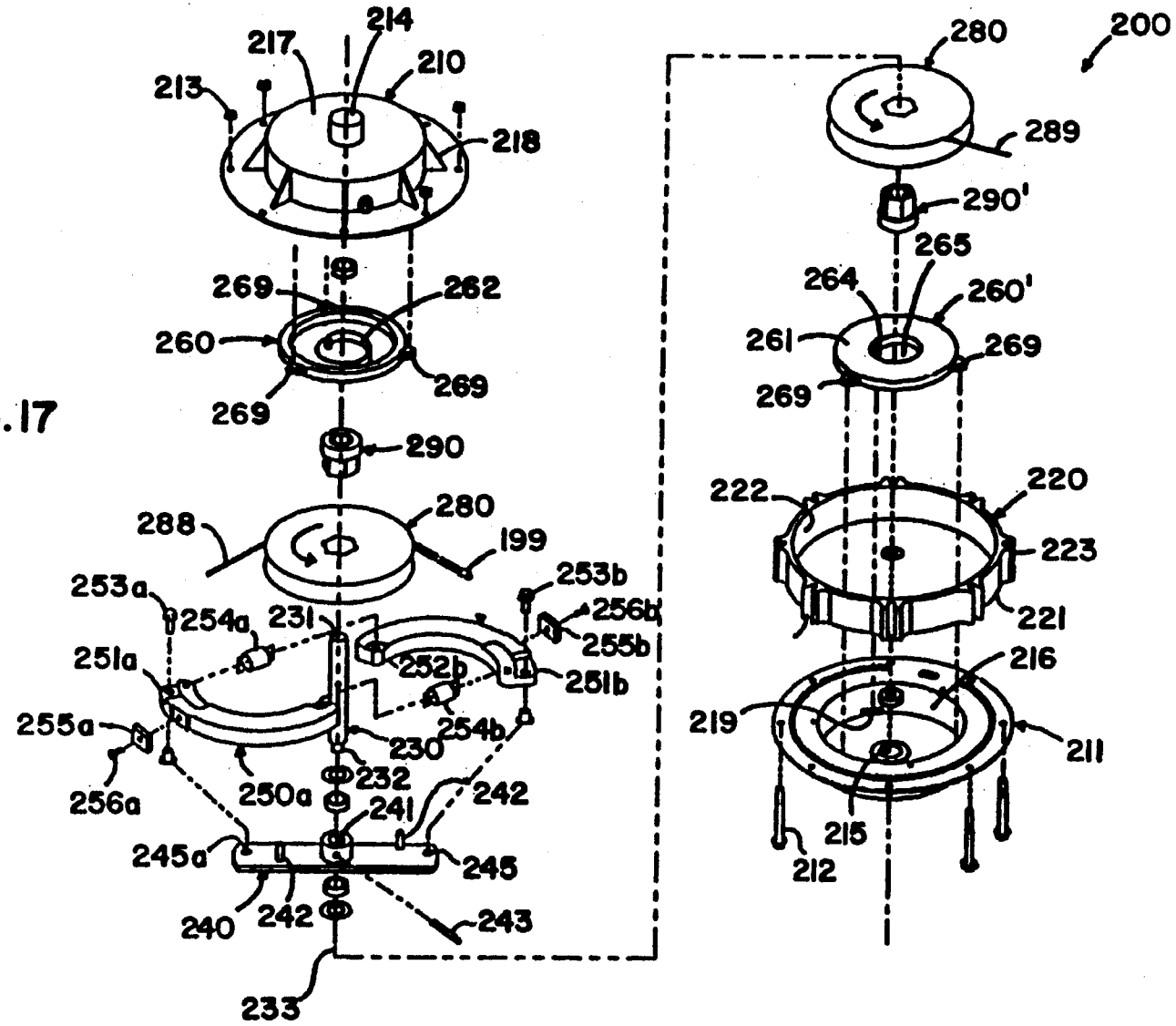
FIG. 17 is an exploded perspective view of a resistance mechanism constructed according to the principles of the present invention and incorporating the arbor shown in FIGS. 12–14 and the reel shown in FIGS. 15–16.

A preferred embodiment exercise resistance mechanism constructed according to the principles of the present invention is designated as 200 in FIG. 17. The resistance mechanism 200 includes a plastic upper housing component 210, a plastic lower housing component 211, and a metal intermediate housing component 220, which cooperate to form a protective housing or case for the other components of the resistance mechanism 200. Each of the upper and lower housing components is a mirror image of the other, and each forms a substantially cylindrical compartment open at one end 216 and closed at an opposite end 217. Each of the housing components has an outwardly extending radial flange proximate the open end 216, and ribs 218 that extend between the flange and the axially extending compartment wall in order to enhance structural integrity. Circumferentially spaced holes formed through each flange align with counterparts on the opposing flange and with channels 223 formed on the exterior of the intermediate housing 220 component, as well. Bolts 212 and nuts 213 cooperate to secure the three housing components together via the holes and the channels.

A shaft 230 extends from a receiving means 214 on the upper housing component 210 to a receiving means 215 on the lower housing component 220 and is rotatably mounted relative thereto. Those skilled in the art will recognize that the other components of the resistance mechanism 200 must be mounted to the shaft or within the housing components before the shaft is connected to both the upper and lower housing components. The shaft extends axially from a first end 231 to a second end 232 and rotates about a shaft axis 233. The shaft 230 extends through a collar 241 on a rotor 240. A pin 243 extends radially through a hole in the collar 241 to secure the rotor 240 to the shaft 230 in such a manner that the rotor rotates together with the shaft.

An arcuate brake shoe **250*a* has a pivot end 251*a* that is rotatably secured to one end of the rotor 240. A rivet 253*a* passes through a hole in the pivot end 251*a* and an aligned hole 245*a* in the end of the rotor. Another arcuate brake shoe 250*b* has a pivot end 251*b* that is rotatably secured to an opposite end of the rotor 240. A rivet 253*b* passes through a hole in the pivot end 251*b* and an aligned hole 245*b* in the opposite end of the rotor. Stops 242 on the rotor 240 limit centripetal travel of the brake shoes 250***a* and 250*b*. The brake shoe 250*a* has a free end 252*a* that is connected to the pivot end 251*b* of the other brake shoe 250*b* by means of a helical spring 254*b*. The brake shoe 250*b* has a free end 252*b* that is connected to the pivot end 251*a* of the other brake shoe 250*a* by means of another helical spring 254*a*. A brake pad 255*a* is mounted to a convex outwardly facing surface on the brake shoe 250*a* by means of a screw 256*a*. A brake pad 255*b* is mounted to a convex outwardly facing surface on the brake shoe 250*b* by means of a screw 256*b*.

Figure 1:
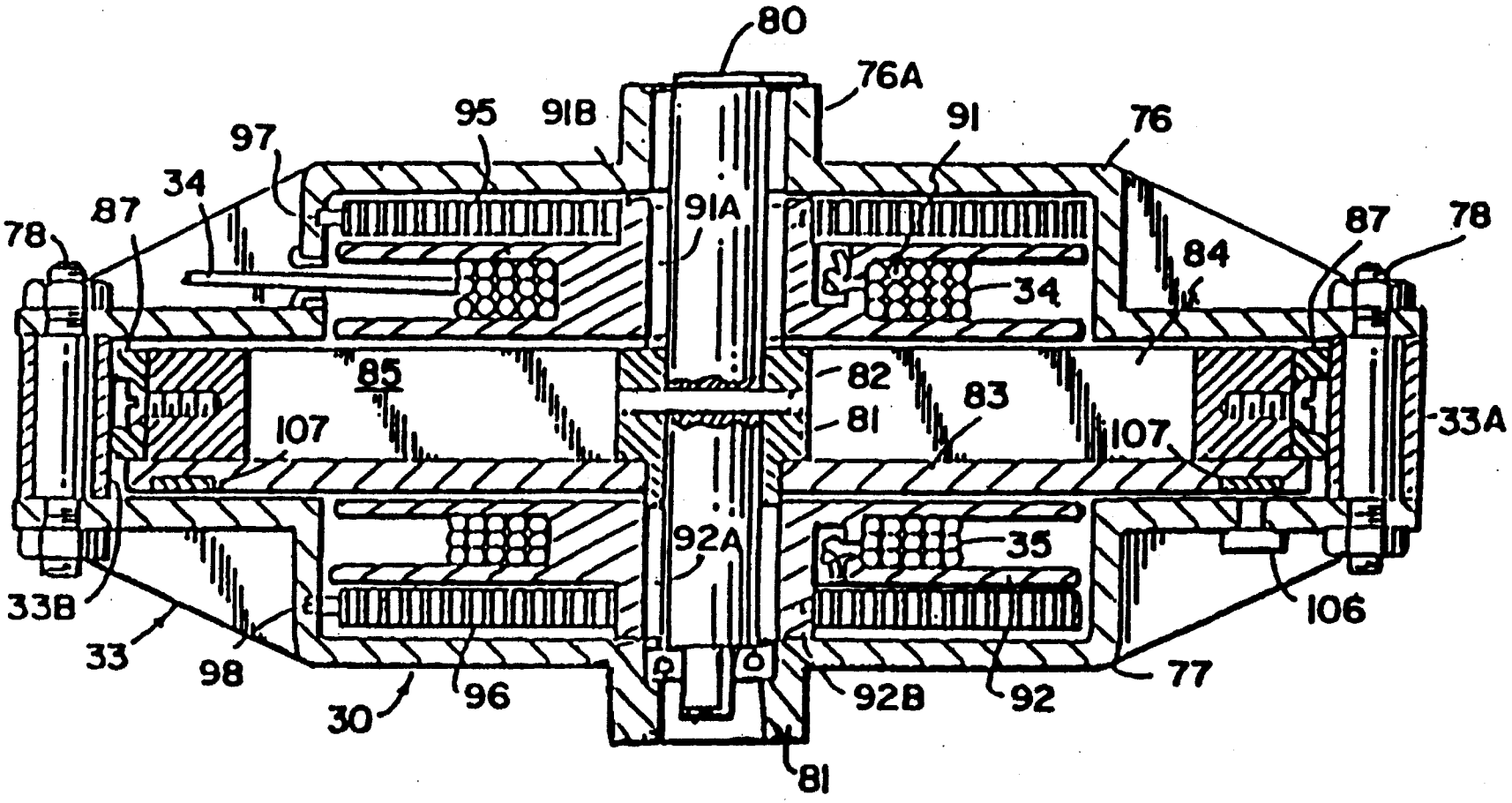
FIG. 1 PRIOR ART
FIG. 1 is a sectioned side view of one embodiment of a Prior Art resistance mechanism disclosed in U.S. Pat. No. 5,147,265.
Figure 2:
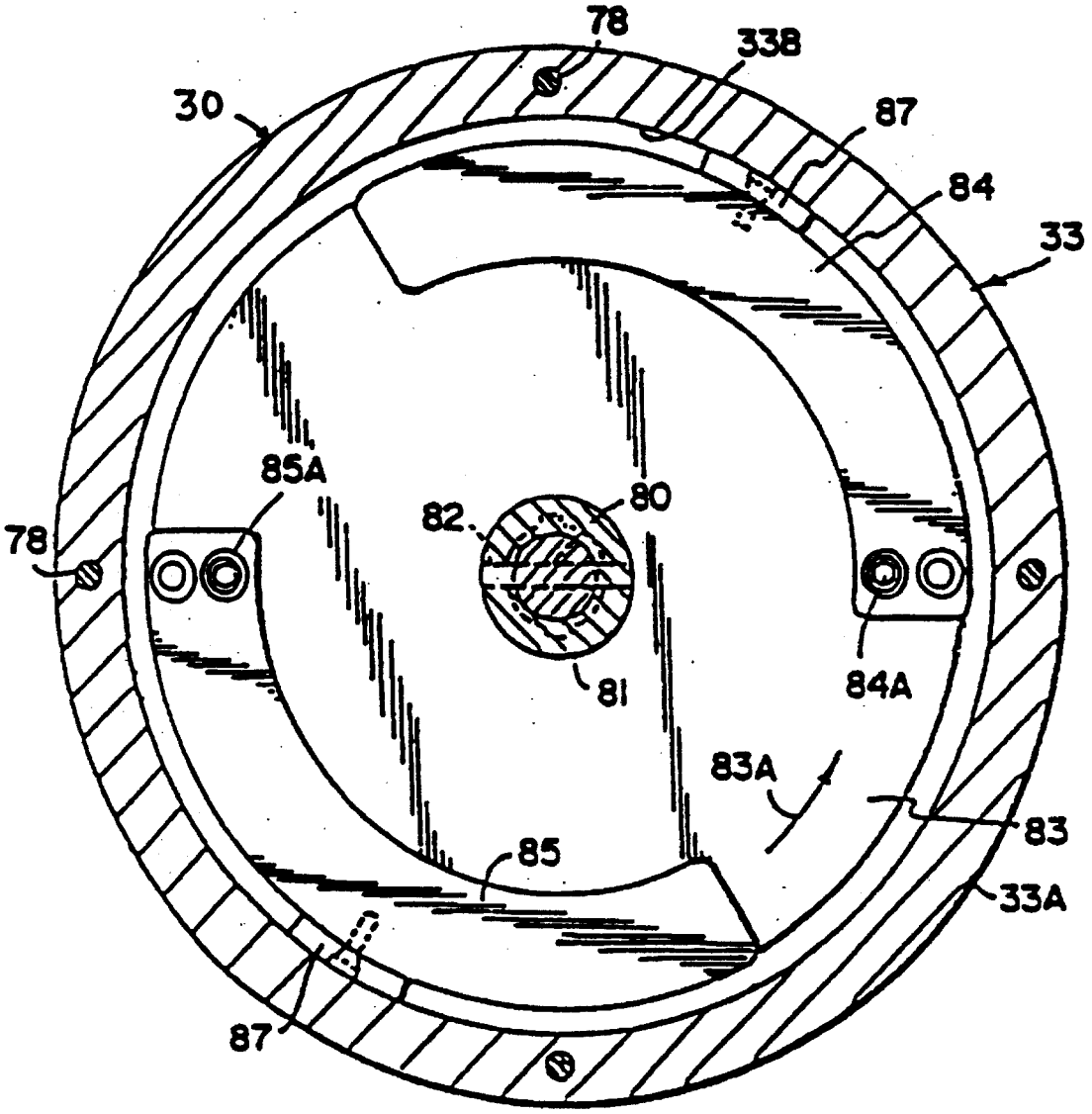
FIG. 2 PRIOR ART
FIG. 2 is a sectioned top view of the Prior Art resistance mechanism shown in FIG. 1.
Figure 3:
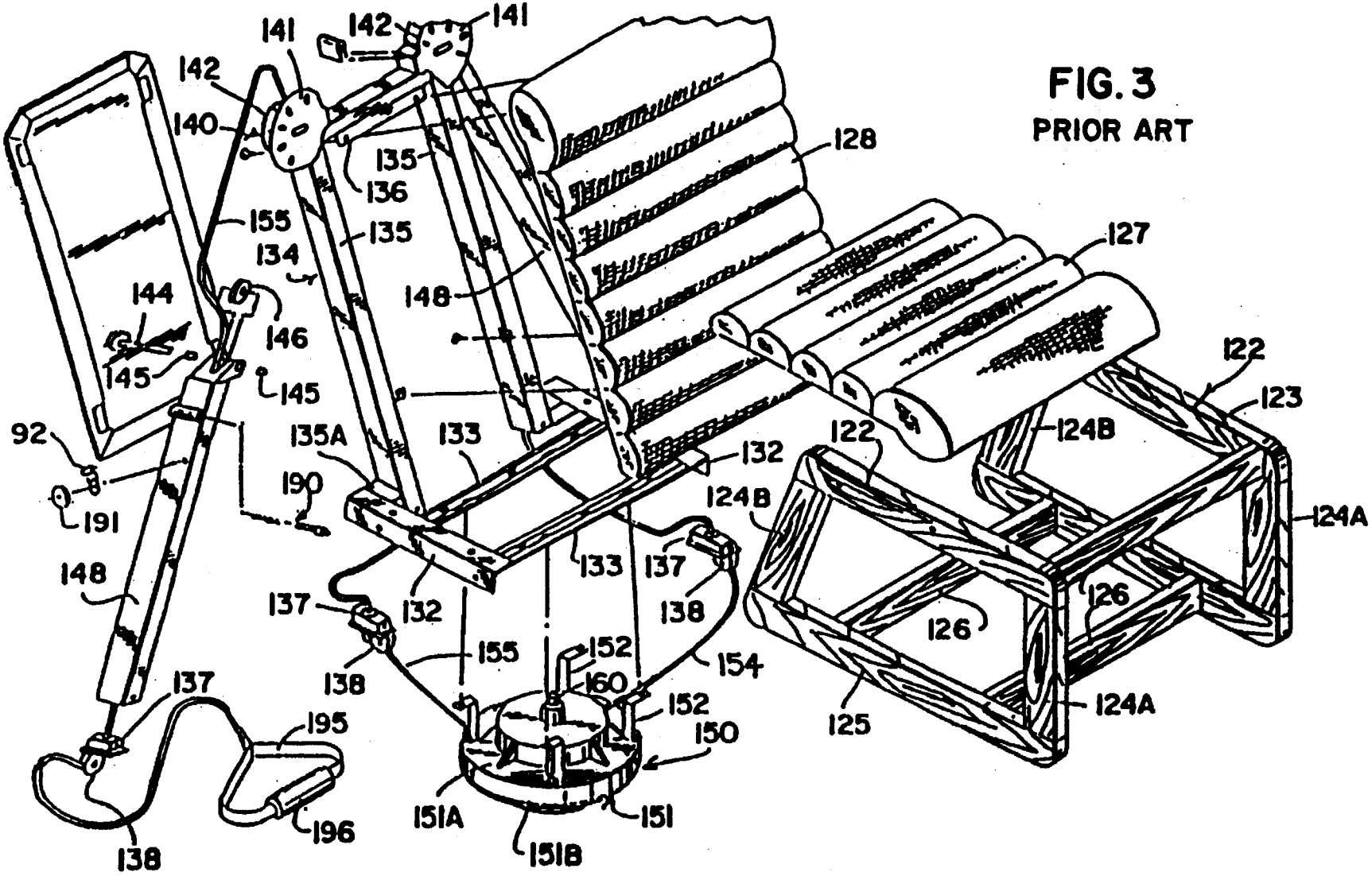
FIG. 3 PRIOR ART
FIG. 3 is an exploded perspective view of a Prior Art exercise chair disclosed in U.S. Pat. No. 5,147,265.
Figure 4:
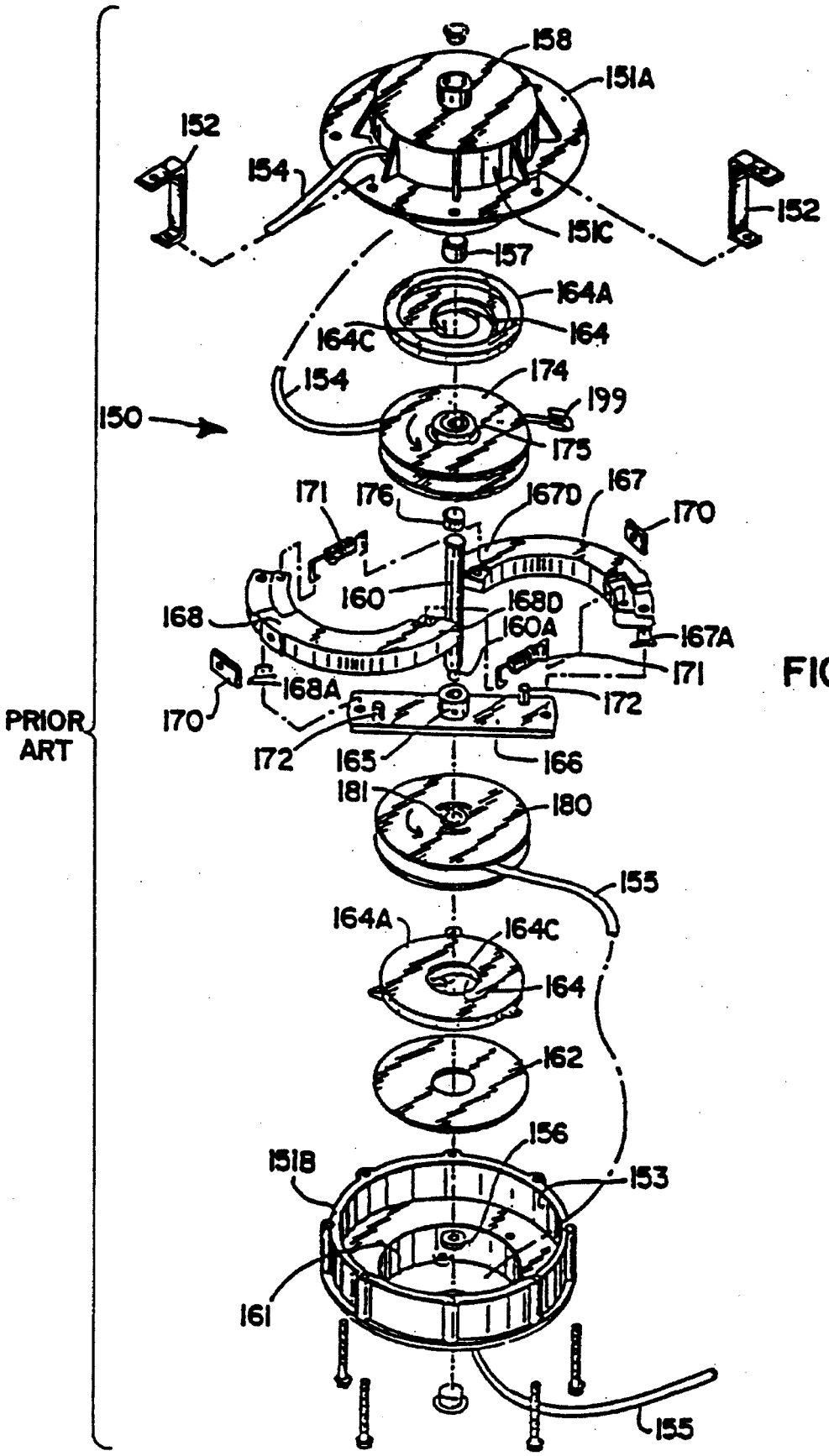
FIG. 4 is an exploded perspective view of another embodiment of a Prior Art resistance mechanism disclosed in U.S. Pat. No. 5,147,265 which is included on the chair shown in FIG. 3.
Figure 5:
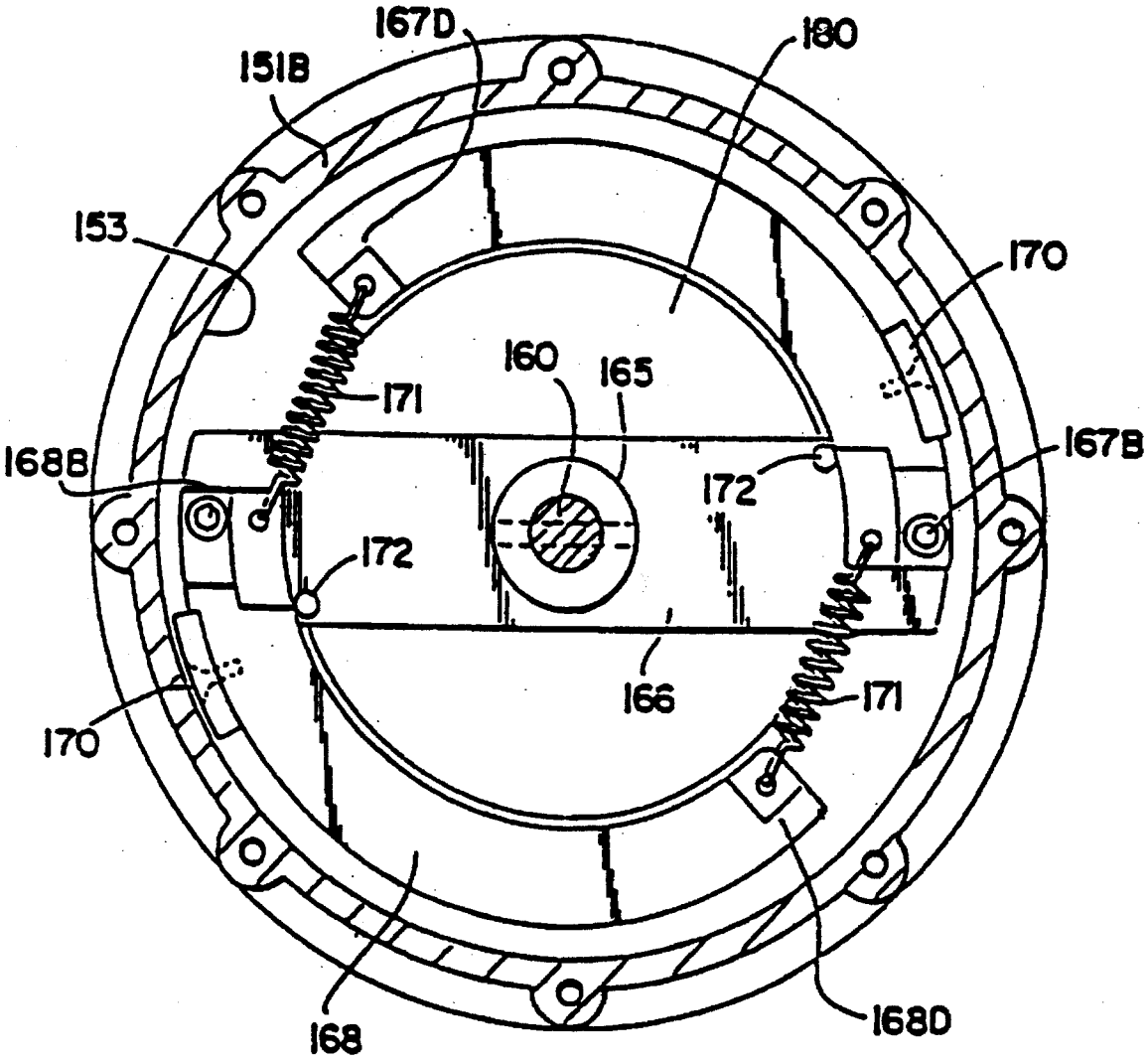
FIG. 5 PRIOR ART
FIG. 5 is a sectioned top view of the Prior Art resistance mechanism shown in FIG. 4.
Figure 6:
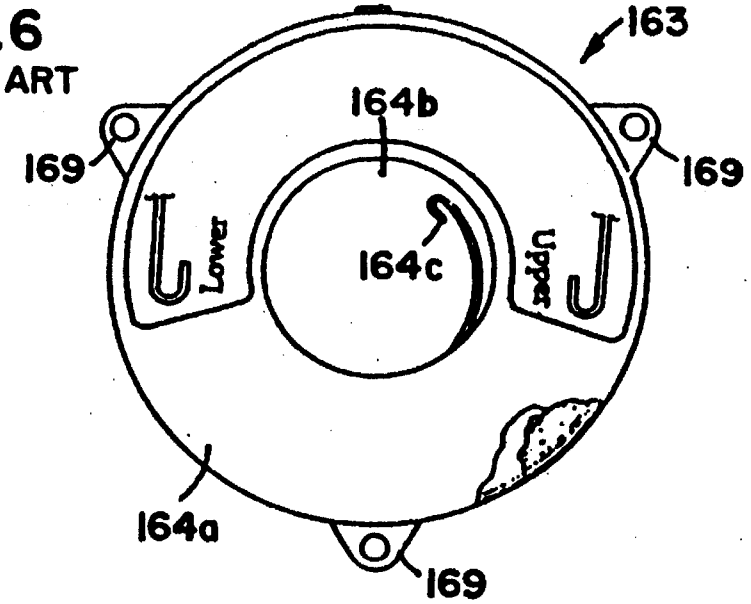
FIG.6 PRIOR ART
FIG. 6 is a top view of a recoil spring pack that forms a part of the Prior Art resistance mechanism shown in FIGS. 4–5.
Figure 7:
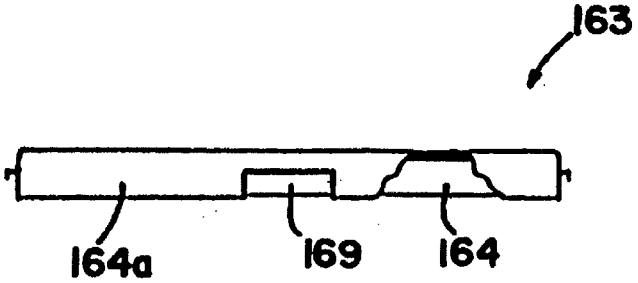
FIG. 7 PRIOR ART
FIG. 7 is a side view of the Prior Art recoil spring pack shown in FIG. 6.
Figure 11:
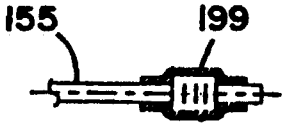
FIG. 11 PRIOR ART
FIG. 11 is a sectioned side view of a line anchor that forms a part of the Prior Art resistance mechanism shown in FIGS. 4–5.
Figure 9:
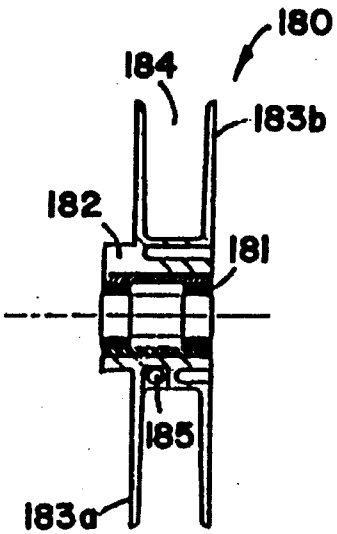
FIG. 9 PRIOR ART
FIG. 9 is a sectioned side view of the Prior Art reel shown in FIG. 8.
Figure 8:
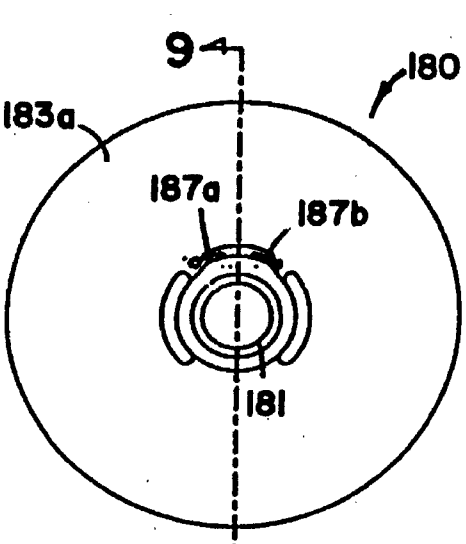
FIG. 8 PRIOR ART
FIG. 8 is a top view of a reel that forms a part of the Prior Art resistance mechanism shown in FIGS. 4–5.
Figure 10:
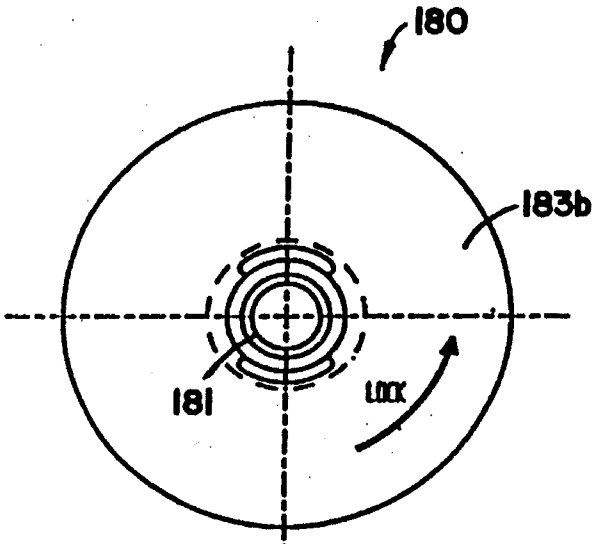
FIG. 10 PRIOR ART
FIG. 10 is a bottom view of the Prior Art reel shown in FIG. 8.

An upper recoil spring pack 260 is mounted within the cylindrical compartment formed by the upper housing component 210, and a lower recoil spring pack 260' is mounted within the cylindrical compartment formed by the lower housing component 211. The recoil spring packs 260 and 260' are similar to the Prior Art spring recoil packs 163 discussed with reference to FIGS. 6–7, except for the manner in which they are mounted within the cylindrical compartments and certain additional improvements that are made possible by this distinction. In particular, the recoil spring packs 260 and 260' of the present invention have tabs 269 that snap fit into recesses 219 formed in the axially extending walls of the cylindrical compartments. The snap fit arrangement saves time during assembly, and allows a relatively larger diameter recoil spring pack, and thus, a more efficient spring, to be used within the same size cylindrical compartment, because the tabs 269 occupy recesses 219 rather than space within the cylindrical compartment. The tabs 269 extend radially outward from a cylindrical shell housing 261 that houses a concentrically wound spring 262 similar to that of the Prior Art spring packs 163. A hooked end 264 of the spring 262 extends into a central aperture 265 through the housing 261. The only meaningful difference between the upper recoil spring pack 260 and the lower recoil spring pack 260' is the direction in which the spring 262 is wound.

Figure 12:
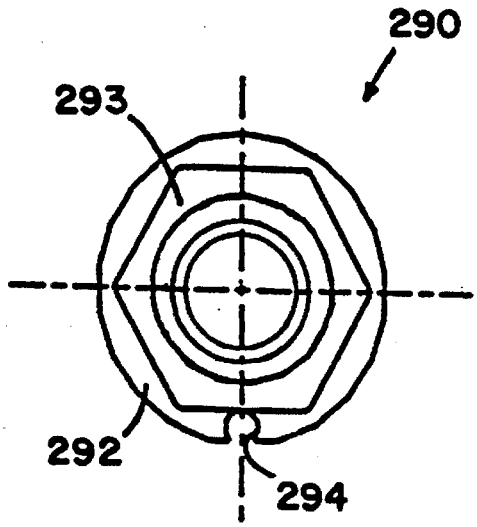
FIG. 12 is a top view of an arbor constructed according to the principles of the present invention.
Figure 13:
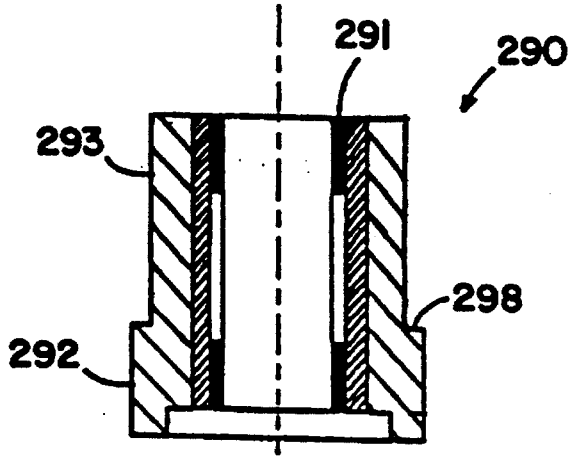
FIG. 13 is a sectioned side view of the arbor shown in FIG. 12.
Figure 14:
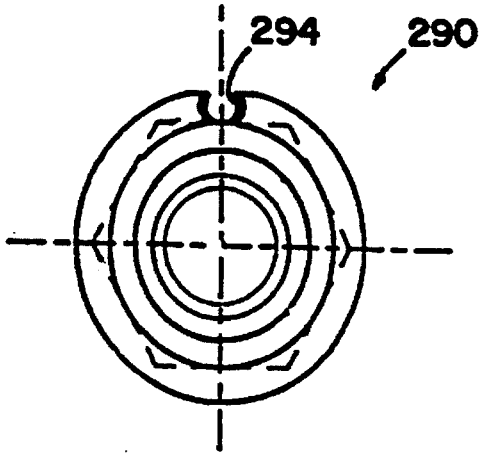
FIG. 14 is a bottom view of the arbor shown in FIG. 12.

An upper arbor 290 is mounted on an upper portion of the shaft 230, and a lower arbor 290' is mounted on a lower portion of the shaft 230. The upper arbor 290, which is representative of the lower arbor 290', is shown in greater detail in FIGS. 12–14. Each arbor includes a one-way clutch assembly 291 mounted within a central bore through the arbor. The one-way clutch assembly 291 mounts the arbor 290 to the shaft 230 in such a manner that the arbor rotates in a first direction together with the shaft (as indicated by arrows on the reels 280 in FIG. 17), and the arbor rotates in a second, opposite direction relative to the shaft. The only meaningful distinction between the arbor 290 and the arbor 290' involves the orientation of the one-way clutch assemblies relative to the shaft. In particular, the clutch assemblies must lock in the same direction of rotation and free-wheel in the same direction of rotation when the arbors 290 and 290' are mounted on the shaft 230 to face toward one another.

Each arbor includes a first portion 292 having a substantially circular profile and a second portion 293 having a hexagonal profile. The first portion 292 has a relatively greater diameter than the second portion 293, and thus, a shoulder 298 is defined at the abutment of the two portions. The relative location of the arbor 290 on the shaft 230 is such that the first portion 292 projects axially into the central aperture 265 in the recoil spring pack 260. A substantially cylindrical notch 294 is formed in the first portion 292 to receive the hooked end 264 of the spring 262. This aspect of the present invention allows an assembly person to connect the spring end 264 to the arbor 290 while in plain view. In this regard, the present invention may be said to provide an improved method of assembling an exercise resistance mechanism of the type herein described. The substantially cylindrical shape of the notch 294 is designed to receive the hooked spring end 264 from either direction, so that only a single configuration is required for both the upper and lower arbors.

Figure 16:
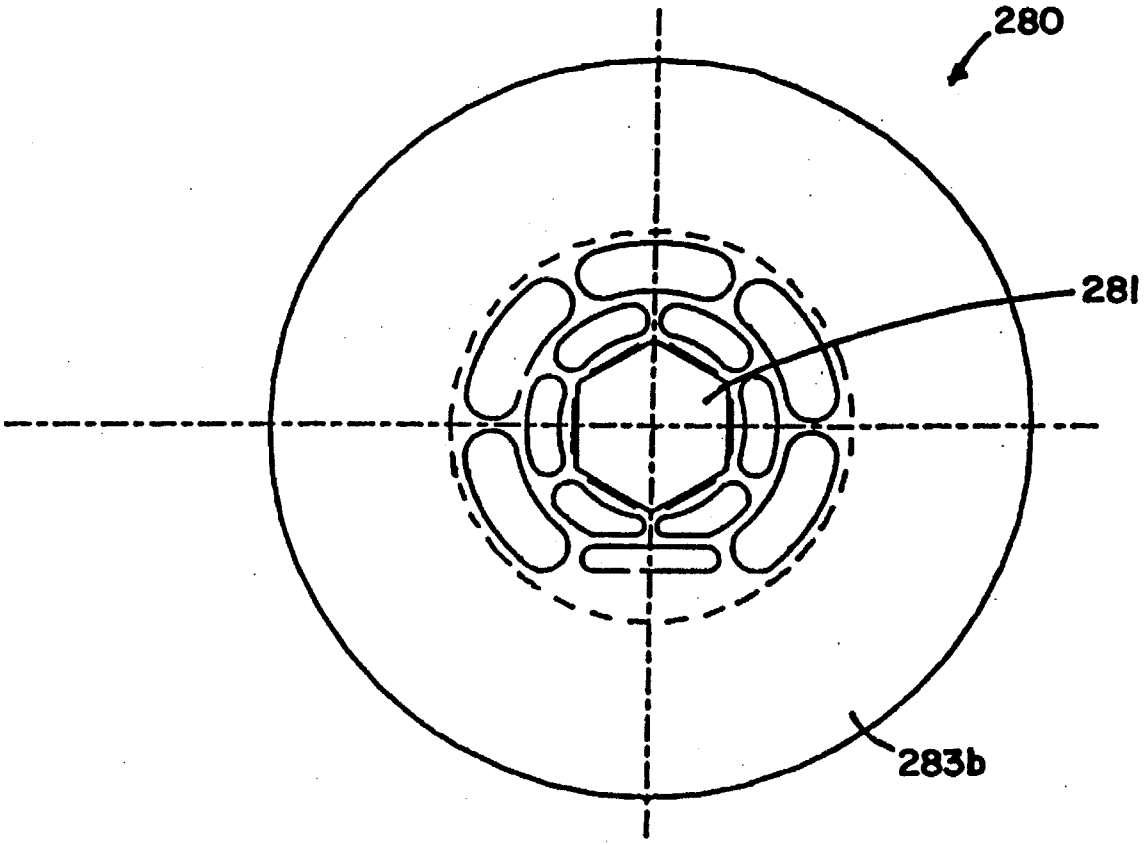
FIG. 16 is a top view of the reel shown in FIG. 15.
Figure 15:
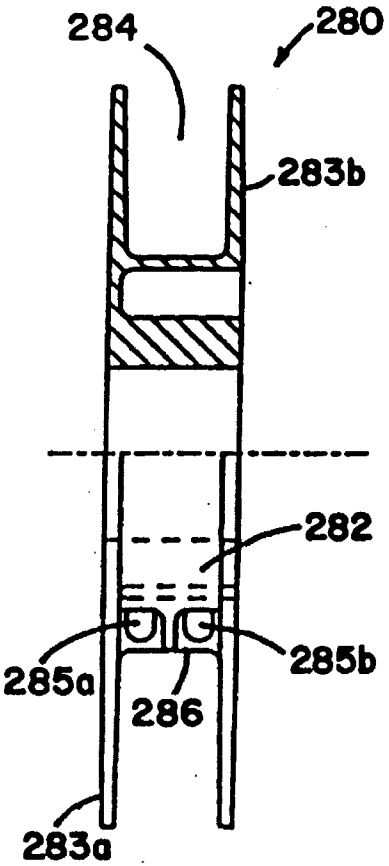
FIG. 15 is a partially sectioned side view of a reel constructed according to the principles of the present invention.

After the spring ends are connected to the arbors, a reel 280 is mounted on the second portion of the upper arbor 290, and another reel 280 is mounted on the second portion of the lower arbor 290'. The shoulder 298 on each arbor provides a surface against which the reel 280 can rest. One of the reels 280 is shown in greater detail in FIGS. 15–16. Each of the reels 280 includes a central aperture 281 having a hexagonal profile that is sized and configured to mate with the hexagonal profile of the second portion 293 of the arbors 290 and 290'. The reels 280 are mounted on the arbors 290 and 290' in such a manner that the reels 280 rotate together with the arbors 290 and 290'. Each of the reels 280 has a hub 282 and a pair of sidewalls 283*a* and 283*b* that extend radially from the hub 282 and define a groove 284 therebetween. The hub 282 of the present invention is relatively larger in diameter than the hub 182 on the Prior Art resistance mechanism 150 in order to enhance structural integrity.

A pair of holes 285*a* and 285*b* are formed through a flange 286 that extends radially from the hub 282 intermediate the sidewalls 283*a* and 283*b*. During assembly, a remote end of a flexible line 288, 289 is threaded through one of the holes (hole 285*a* for purposes of discussion), and substantially the entire length of the flexible line is pulled through the hole 285*a*. An anchor 199 on the opposite end of the flexible line prevents the opposite end from being pulled through the hole 285*a*. Alternatively, the end of the line to be anchored to the reel can be inserted through the hole 285*a*, and then the anchor 199 can be secured to the line. Once the opposite end of the flexible line is anchored to the flange 286, and the remote end of the flexible line is connected to an operable exercise element, the slack in the flexible line is wound about the hub 282 between the sidewalls 283*a* and 283*b*. Specific applications for the present invention are disclosed in U.S. Pat. Nos. 5,090,694 and 5,195,937, which are incorporated herein by reference to the extent that they facilitate understanding of the present invention and its operation.

In operation, the mechanism 200 provides very desirable and effective resistance to exercise movement. When a person causes either and/or both of the flexible lines 288 and 289 to be unwound from their respective reels 280 (in the direction indicated by arrows on the reels 280 in FIG. 17), the reels 280 and their respective arbors 290 and 290' rotate and increase torque in their respective rewind springs 262. Also, the one-way clutch assemblies 291 grip and rotate the shaft 230, thereby causing the brake shoes 250*a* and 250*b* to pivot outward and forcing the brake pads 255*a* and 255*b* against the cylindrical contact surface 222. Thus, unwinding of the lines is resisted by friction between the brake pads and the cylindrical contact surface, and to a much lesser degree by torque in the rewind springs. When a person releases a flexible line, the torque in the rewind spring 262 causes the reel 280 to rotate in the opposite direction, and the one-way clutch assemblies 291 release and rotate relative to the shaft 230.

After extended use, a flexible line may require replacement, which is facilitated by the provision of a pair of holes 285*a* and 285*b* on the reel 280. In order to replace a flexible line, a person must first unwind the original line, thereby increasing torque in the rewind spring. However, contrary to the Prior Art, the present invention does not require complete removal of the original line. Rather, the original line is held in one hand while the other hand is used to thread the replacement line through the unoccupied hole (hole 285*b* for purposes of discussion). When the replacement line has been pulled through the hole 285*b* to the extent that the anchor 199 prevents further pulling, the replacement line serves as a handle while the original line is completely removed. With the original line out of the way, the replacement line is released, and the torque in the rewind spring winds the replacement line onto the reel. In this regard, the present invention may be said to provide an improved method of replacing a flexible line on an exercise resistance mechanism of the type herein described.

Figure 18:
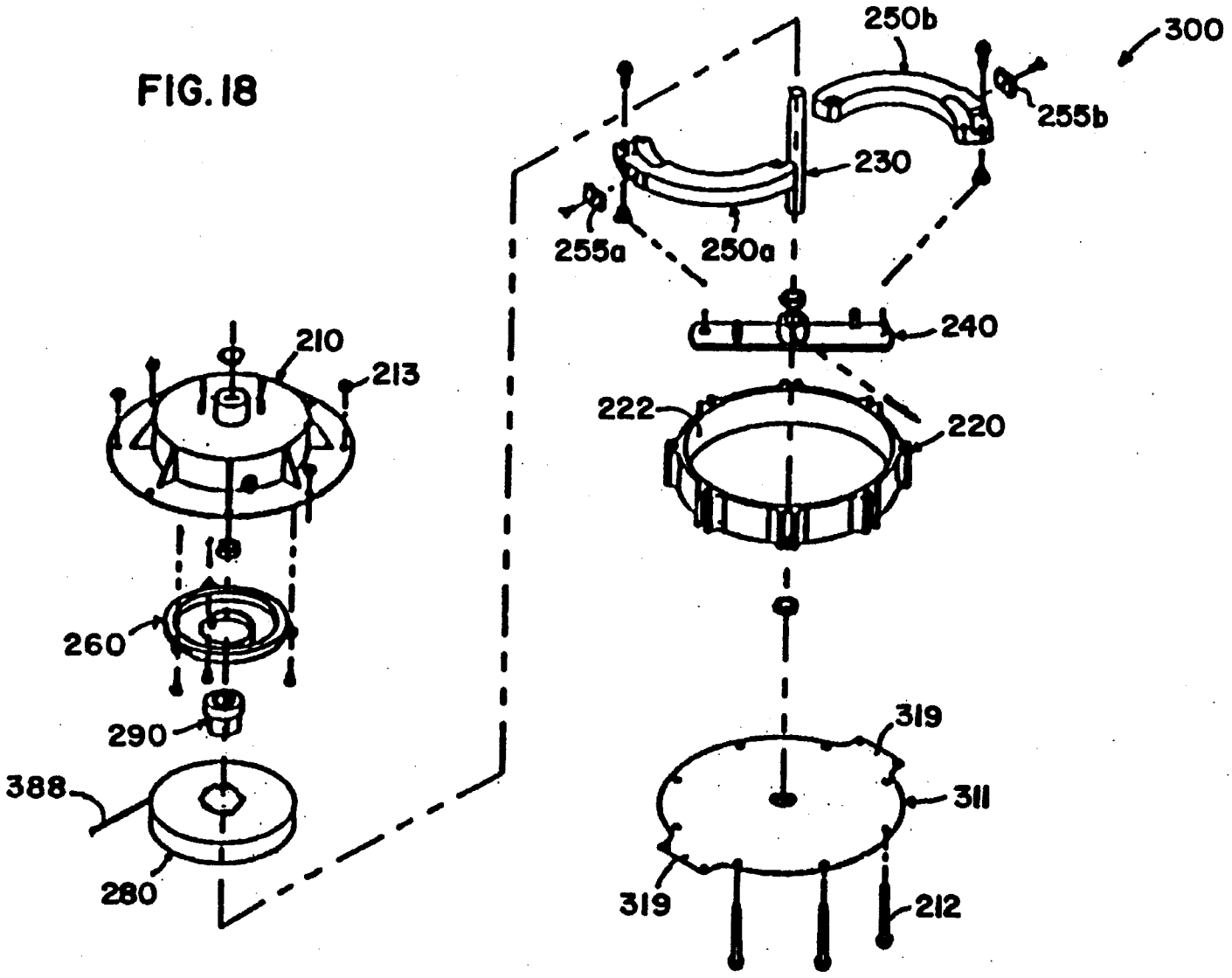
FIG. 18 is an exploded perspective view of another resistance mechanism constructed according to the principles of the present invention and incorporating the arbor shown in FIGS. 12–14 and the reel shown in FIGS. 15–16.

An alternative embodiment of the present invention is designated as 300 in FIG. 18. The alternative embodiment 300 is similar to the preferred embodiment 200 but is designed to accommodate only a single flexible line 388. Thus, the alternative embodiment 300 requires only one recoil spring pack 260, one arbor 290, and one reel 280. The only significant change involves the lower housing component 311 which is merely a metal sheet in this alternative embodiment 300. Flanges 319 extend from the sheet 311 to provide a means for mounting the mechanism 300 to exercise equipment.

Although the present invention has been described with reference to particular embodiments and applications, those skilled in the art will recognize additional embodiments and applications that fall within the scope of the present invention. Accordingly, the present invention is to be limited only by the appended claims.

We claim:

1. A resistance mechanism for exercise equipment, comprising:

a flexible line;

a reel;

a first line securing means on said reel for securing said flexible line to said reel, wherein an end of said flexible line is secured to said first line securing means, and said flexible line is wound about said reel;

a resistance means for resisting unwinding of said flexible line from said reel;

a rewinding means for rewinding said flexible line about said reel; and a second line securing means on said reel for securing a replacement line to said reel, wherein said flexible line can be completely unwound from said reel and held while an end of said replacement line is secured to said second line securing means, such that said replacement line will automatically wind onto said reel when said flexible line is freed from said first line securing means.

2. A resistance mechanism according to claim 1, wherein said reel includes a hub, and said first line securing means includes a hole formed through a portion of said reel proximate said hub, and said end of said flexible line is passed through said hole and secured relative to said portion by means of an anchor on said flexible line.

3. A resistance mechanism according to claim 2, wherein said second line securing means includes another hole formed through another portion of said reel proximate said hub, and said end of said replacement line is passed through said another hole and secured relative to said another portion by means of an anchor on said replacement line.

4. A resistance mechanism according to claim 3, wherein said portion and said another portion are adjacently located on said reel and integrally joined to said hub.

5. A resistance mechanism according to claim 1, further comprising a housing, wherein said reel is rotatably mounted within said housing.

6. A resistance mechanism according to claim 5, wherein said housing includes an inwardly facing cylindrical contact surface, and said resistance means includes at least one brake shoe operatively connected to said reel in such a manner that said at least one brake shoe rotates as said reel rotates in response to unwinding of said flexible line, and a brake pad on said at least one brake shoe pivots outward against said contact surface as said flexible line is unwound from said reel, whereby friction between said brake pad and said contact surface provide resistance to unwinding of said flexible line from said reel.

7. A resistance mechanism according to claim 6, wherein said rewinding means includes a torsion spring operatively connected to said reel in such a manner that said torsion spring stores energy as said flexible line is unwound from said reel and releases energy to rewind said flexible line onto said reel.

8. A resistance mechanism according to claim 5, wherein said rewinding means includes a recoil spring pack having a torsion spring disposed within a casing, and said casing is secured within said housing by snap fitting tabs on said casing that engage recesses in said housing, and an end of said torsion spring is operatively connected to said reel in such a manner that said torsion spring stores energy as said flexible line is unwound from said reel and releases energy to rewind said flexible line onto said reel.

9. A resistance mechanism according to claim 1, further comprising a shaft, and an arbor rotatably mounted to said shaft, wherein said reel is mounted to said arbor in such a manner that said reel rotates together with said arbor, and said rewinding means includes a torsion spring operatively connected to said arbor in such a manner that said torsion spring stores energy as said reel rotates in a first direction in response to unwinding of said flexible line, and said torsion spring releases energy to rotate said reel in a second, opposite direction to rewind said flexible line onto said reel.

10. A resistance mechanism according to claim 1, wherein said reel includes a hub and rotates about an axis, and said first line securing means includes a flange extending radially from said hub, and a first hole formed through said flange, and said second line securing means includes a second hole formed through said flange and axially spaced from said first hole.

11. A resistance mechanism for exercise equipment, comprising:

a shaft that rotates about an axis;

a recoil spring pack having a central aperture and a spring end extending into said central aperture, wherein said shaft extends axially through said central aperture;

an arbor connected to said shaft by means of a one way clutch in such a manner that said arbor rotates in a first direction together with said shaft, and said arbor rotates in a second, opposite direction relative to said shaft, wherein said arbor has a first portion disposed within said central aperture and a second portion disposed outside said central aperture, and said spring end is connected to said first portion in such a manner that rotation of said arbor in said first direction stores energy in said spring, and rotation of said arbor in said second, opposite direction releases energy from said spring;

a reel connected to said second portion of said arbor in such a manner that said reel rotates together with said arbor;

a flexible line wound about said reel in such a manner that unwinding of said flexible line from said reel causes said reel and said arbor to rotate in said first direction together with said shaft; and a resistance means connected to said shaft for resisting rotation of said shaft in said first direction.

12. A resistance mechanism according to claim 11, further comprising a first line securing means on said reel for securing an end of said flexible line to said reel, and a second line securing means on said reel for securing a replacement line to said reel while said flexible line is still secured to said reel.

13. A resistance mechanism according to claim 12, wherein said reel includes a hub and a flange extending radially from said hub, and said first line securing means includes a first hole formed through said flange, and said second line securing means includes a second hole formed through said flange.

14. A resistance mechanism according to claim 11, wherein said first portion of said arbor has a substantially circular perimeter, and a substantially circular notch is formed in said perimeter to receive and retain said spring end.

15. A resistance mechanism according to claim 14, wherein said second portion of said arbor has a hexagonal perimeter, and said reel has a hexagonal central aperture sized and configured to mate with said hexagonal perimeter.

16. A resistance mechanism according to claim 11, further comprising a housing, wherein said shaft is rotatably mounted within said housing, and said recoil spring pack, said arbor, said reel, and said resistance means are axially aligned with said shaft and disposed within said housing.

17. A resistance mechanism according to claim 16, wherein said housing includes a substantially cylindrical compartment having a closed end and an open end, and said recoil spring pack is secured within said compartment, and said reel is adjacent to said recoil spring pack and effectively seals off said recoil spring pack from said open end.

18. A resistance mechanism according to claim 17, wherein said first portion of said arbor has a larger effective diameter than said second portion, and said first portion is effectively captured between said reel and said closed end.

19. A resistance mechanism for exercise equipment, comprising:

a shaft that rotates about an axis;

a recoil spring pack having a central aperture and a spring end extending into said central aperture, wherein said shaft extends axially through said central aperture;

an arbor connected to said shaft by means of a one way clutch in such a manner that said arbor rotates in a first direction together with said shaft, and said arbor rotates in a second, opposite direction relative to said shaft, wherein said arbor has a first portion disposed within said central aperture and a second portion disposed outside said central aperture, and said spring end is connected to said first portion in such a manner that rotation of said arbor in said first direction stores energy in said spring, and rotation of said arbor in said second, opposite direction releases energy from said spring;

a reel connected to said second portion of said arbor in such a manner that said reel rotates together with said arbor;

a flexible line wound about said reel in such a manner that unwinding of said flexible line from said reel causes said reel and said arbor to rotate in said first direction together with said shaft;

a resistance means connected to said shaft for resisting rotation of said shaft in said first direction; and a housing, wherein said shaft is rotatably mounted within said housing, and said recoil spring pack, said arbor, said reel, and said resistance means are axially aligned with said shaft and disposed within said housing, and wherein said housing provides an inwardly facing cylindrical contact surface, and said resistance means includes a rotor connected to said shaft in such a manner that said rotor rotates together with said shaft, and at least one brake shoe is pivotally mounted on said rotor in such a manner that rotation of said rotor causes said at least one brake shoe to pivot toward said cylindrical contact surface and forces a brake pad on said at least one brake shoe into contact with said cylindrical contact surface.

20. A resistance mechanism for exercise equipment, comprising:

a shaft that rotates about an axis;

a recoil spring pack having a central aperture and a spring end extending into said central aperture, wherein said shaft extends axially through said central aperture;

an arbor connected to said shaft by means of a one way clutch in such a manner that said arbor rotates in a first direction together with said shaft, and said arbor rotates in a second, opposite direction relative to said shaft, wherein said arbor has a first portion disposed within said central aperture and a second portion disposed outside said central aperture, and said spring end is connected to said first portion in such a manner that rotation of said arbor in said first direction stores energy in said spring, and rotation of said arbor in said second, opposite direction releases energy from said spring;

a reel connected to said second portion of said arbor in such a manner that said reel rotates together with said arbor;

a flexible line wound about said reel in such a manner that unwinding of said flexible line from said reel causes said reel and said arbor to rotate in said first direction together with said shaft;

a resistance means connected to said shaft for resisting rotation of said shaft in said first direction; and a housing, wherein said shaft is rotatably mounted within said housing, and said recoil spring pack, said arbor, said reel, and said resistance means are axially aligned with said shaft and disposed within said housing, and wherein said recoil spring pack is secured to said housing by means of outwardly extending tabs on said recoil spring pack that snap fit into recesses in said housing.

* * * * *